US005592764A

United States Patent [19]

Boulud et al.

[11] Patent Number: 5,592,764

[45] Date of Patent: Jan. 14, 1997

[54] EVAPORATION CHAMBER WITH ANTI-CALEFACTION LAYER

[75] Inventors: Henry Boulud, La Plaine; Jean-Louis Brandolini, Saint-Etienne, both of France

[73] Assignee: SEB S.A., Awlongey, France

[21] Appl. No.: 397,058

[22] PCT Filed: Jul. 13, 1994

[86] PCT No.: PCT/FR94/00877

§ 371 Date: Apr. 27, 1995

§ 102(e) Date: Apr. 27, 1995

[87] PCT Pub. No.: WO95/02787

PCT Pub. Date: Jan. 26, 1995

[30] Foreign Application Priority Data

Jul. 16, 1993 [FR] France ..... 93 08988

[51] Int. Cl.[6] ..... D06F 75/18

[52] U.S. Cl. ..... 38/77.83

[58] Field of Search ..... 38/77.83, 93, 77.8; 219/245, 154

[56] References Cited

U.S. PATENT DOCUMENTS

| | | | |
|---|---|---|---|
| 2,683,320 | 7/1954 | Morton | 38/77.83 |
| 2,792,652 | 5/1957 | Dawson | 38/77.83 |
| 3,218,741 | 11/1965 | Martin | 38/77.83 |
| 3,499,237 | 3/1970 | Piper | 38/77.83 |
| 3,694,942 | 10/1972 | Vondracek et al. | 38/77.83 |
| 5,390,432 | 2/1995 | Boulud et al. | 38/77.83 |

FOREIGN PATENT DOCUMENTS

| | | | |
|---|---|---|---|
| 425043 | 5/1991 | European Pat. Off. . | |
| 1134066 | 7/1955 | France . | |
| 1359794 | 3/1963 | France . | |
| 3006783 | 8/1981 | Germany . | |
| 160999 | 8/1985 | Japan | 38/77.83 |
| 2077624 | 6/1980 | United Kingdom . | |
| 9400877 | 1/1995 | WIPO . | |

*Primary Examiner*—Ismael Izaguirre
*Attorney, Agent, or Firm*—Loeb & Loeb LLP

[57] ABSTRACT

A steam generating device including an evaporation chamber for evaporating a liquid which is delivered from a reservoir while the chamber is being heated, which chamber includes a base composed of: a body of thermally conductive material having an upper surface against which the liquid to be evaporated is directed, the body having a surface layer extending from the upper surface; and hydrophilic fibers distributed across the upper surface and at least partially and locally embedded in the surface layer.

A process for producing a base of an evaporation chamber, the base being composed of a body of thermally conductive material having an upper surface, the process being composed of intimately binding fibers of thermally insulating, hydrophilic material with the body of thermally conductive material in a layer at the upper surface, and at least partially impregnating the fibers with the thermally conductive material in order to promote heat transfer from the base to liquid which is present on the upper surface in order to evaporate the liquid.

16 Claims, 1 Drawing Sheet

EVAPORATION CHAMBER WITH ANTI-CALEFACTION LAYER

TECHNICAL FIELD

The present invention relates to the technical field of apparatus for evaporating fluids and in particular to the field of steam pressing irons.

The present invention concerns on the one hand an anti-calefaction layer arranged in an evaporation chamber and on the other hand a process for fabricating such a layer intended equally to evaporate a pressing liquid, in this case generally water.

PRIOR ART

It is already known in the prior art to form anti-calefaction layers notably by supplying special coatings which are sprayed or applied with a brush such as sodium silicate, solutions of ceramic materials, of silicate or of silica. These coatings are in general applied to evaporation chambers.

These products or other equivalent products are known for their hydrophilic and wettability properties assuring a spreading and a diffusion of the water on the base of the evaporation chamber. One thus obtains a better evaporation of the water, translating into a reduction in the emission of water in liquid form by the intermediary of steam outlets situated under the sole plate of a pressing iron, for example.

It is equally known to utilize mineral fiber or synthetic fabrics, disposed in the evaporation chamber. The fabrics are generally maintained in place by mechanical means. These latters are constituted by springs, rivets or a retention grid.

The different solutions provided by the prior art do not permit however sufficient limiting of the calefaction in the evaporation chambers. Calefaction is produced in general by bringing a liquid into contact with a very hot surface. The projection of a small quantity of liquid on such a surface provokes the appearance of drops which move randomly on said surface and which are only evaporated after a relatively long time interval. The contact between a liquid drop and the hot surface generates steam which lodges between said surface and the base of said drop which is directed toward this surface. The cushion of steam thus formed aids movement of the drop on the hot surface and considerably reduces evaporation.

Calefaction phenomena increase the duration of evaporation and consequently reduce the effectiveness of known coatings. These latters, in particular, sprayed coatings are poorly resistant to the acidity often presented by the fluid to be evaporated. This is notably the case for water.

Known coatings of the sodium silicate type or other equivalent products also present a resistance which one can qualify as insufficient to thermal shocks and a limited adherence to the base of the evaporation chamber. One can also note a marked tendency for dissolution of these products in water, thus strongly reducing the useful life of pressing irons.

In addition, the fabric fibers utilized in the prior art are maintained in place by the intermediary of various mechanical means. These latters considerably increase the complexity of fabrication or of formation of said evaporation layers. Moreover, this more complicated production is linked to the utilization of a large number of parts. These different factors are responsible for a significant fabrication cost. This is particularly the case during fabrication of pressing iron sole plates comprising an evaporation chamber furnished with such a coating.

The object assigned to the invention aims in consequence to remedy the different inconveniences enumerated previously and to furnish a device for generating steam of which the evaporation quality is improved.

The object of the present invention aims to furnish a device for generating steam comprising an evaporation chamber furnished with an evaporation base permitting rapid evaporation of a liquid while limiting the calefaction phenomenon.

The object of the present invention also aims to furnish a device for generating this steam which presents, besides a reduction in the calefaction phenomenon, a base which is almost insensitive to a possible acidity of the liquid to be evaporated.

Another object of the present invention aims to furnish a mechanically strong base of an evaporation chamber fixed with a sole plate of a pressing iron, for example, without utilizing additional mechanical means.

Another object of the present invention aims to furnish a device for generating steam whose evaporation chamber presents an anti-calefaction layer insensitive to thermal shocks and strongly adherent to the base of said chamber in a manner to assure an optimal thermal transfer.

The invention has equally for its object to furnish a simple and effective process for producing an anti-calefaction layer in an evaporation chamber of a steam generation device.

An additional goal of the invention aims to furnish a steam generation device which is effective and reliable, of which the fabrication cost is substantially reduced and of which the useful life will be found increased at the same time.

SUMMARY OF THE INVENTION

The goals assigned to the invention are achieved with the aid of a device for generating steam comprising a heating means in thermal communication with an evaporation chamber, a reservoir for liquid communicating with the evaporation chamber, which comprises a base against which is directed the liquid intended to be evaporated, said base comprising a zone defining a surface layer partly embedded in the base at the interior of the evaporation chamber, characterized in that the layer presents on the entirety of its surface hydrophilic fibers at least partially and locally embedded in the constituent material of the layer.

The goals assigned to the invention are equally achieved with the aid of a process for producing a base of an evaporation chamber consisting in utilizing thermally isolating and hydrophilic fibers as well as a thermally conductive material of the aluminum type, characterized in that it consists in intimately binding the fibers with the base in a layer of a surface zone of said base, in a manner to assure a thermal transfer between the base and the layer which at least partially impregnates said fibers.

BRIEF DESCRIPTION OF THE DRAWINGS

The characteristics and the advantages of the invention will become more apparent from a reading of the description given below by way of non-limiting example, with reference to the attached drawings in which.

PREFERRED MANNER OF CARRYING OUT THE INVENTION

As an example of a form of construction, reference will be made to steam pressing irons.

The device for generating steam (not shown in the figures) comprises an evaporation chamber (not shown in the figures), and to which is introduced the liquid to be evaporated, coming from a reservoir. This latter comprises for example an outlet in line with an impact-zone on a base 3 of the evaporation chamber. The base 3 is constituted by a material to which is thermally conductive and preferably metallic. Advantageously, material 2 is either of aluminum or of an alloy containing aluminum.

Figure 1:
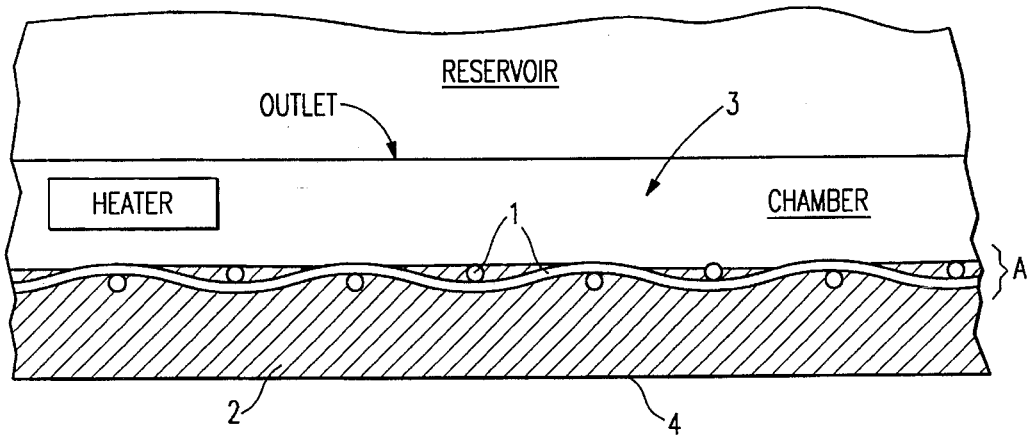
FIG. 1 represents a transverse cross-sectional view of the base of an evaporation chamber of a steam generation device according to the invention.

In the embodiment shown in FIG. 1, base 3 comprises in a surface zone woven fibers 1 having hydrophilic and thermal isolation properties, embedded at least partially and locally in material 2 constituting base 3 and consequently a surface layer A of said base 3.

Advantageously, the surface zone thus created extends over at least one part of at least one wall of the evaporation chamber, said wall being opposite an inlet orifice for liquid to be evaporated.

Layer A thus comprises in part fibers 1 at least partially and locally impregnated by the constituent material of layer A. This latter is thus obviously situated within an evaporation chamber, facing an orifice intended for injecting a liquid into said evaporation chamber.

Fibers 1 penetrate at least partially and locally into layer A. Fibers 1 are in this manner integrated in places in material 2 constituting base 3.

This latter thus comprises a surface layer A in which are locally embedded fibers which are arranged between themselves, for example as a mesh.

According to a preferred embodiment of an evaporation chamber of a device according to the invention, fibers 1 are over-molded into layer A. When the material 2 is solidified after the over-molding operation, fibers 1 are embedded in part in said material 2 and are visible in part. Certain of them are along a portion of their length either totally embedded in material 2 or partially embedded in material 2, or entirely visible and disengaged from the material 2. Others among them are embedded in material 2 over a large part of their length or are totally free from material 2.

These different possible configurations are distributed randomly on the surface of base 3. In effect, by the intermediary of a knitting or weaving of said fibers 1, the material 2 locally impregnates, partially or totally, the fabric of fibers 1 thus produced. The mesh or woven material is in this manner maintained effectively in a surface layer A of base 3.

Base 3 is thus found to be unified with fibers 1 in a superficial zone corresponding to layer A.

The overall structure thus presents a rigidity and a solidity adapted to the mechanical constraints of the type of expansions and contractions due to temperature variations. Heterogenous layer A thus absorbs in a satisfactory manner the very frequent thermal shocks in a pressing iron sole plate.

The phenomenon of calefaction which is generally produced on evaporation surfaces is reduced on the one hand by the utilization of hydrophilic fibers 1 and on the other hand by a reduced heating temperature in the surface zone of base 3.

In effect, said surface zone is constituted by two materials, one thermally isolating, of the ceramic fibers type, the other thermally conductive of the aluminum type for example.

Impregnation of the fibers with ceramic material provokes a slight drop in temperature on the surface against which the liquid to be evaporated is brought with respect to the temperature of the material 2 constituting base 3. Layer A thus serves as a slight thermal screen.

Heterogenous layer A presents in addition a surface, onto which is conducted the liquid intended to be evaporated, which is constituted in large part by hydrophilic fibers 1, preferably woven, which at least partially absorb and diffuse the liquid and/or absorb said liquid into said layer A. The temperature drop at the surface of base 3 and the hydrophilic and wetting properties combine to reduce the calefaction phenomenon. In consequence, evaporation is found to be improved and accelerated.

Figure 2:
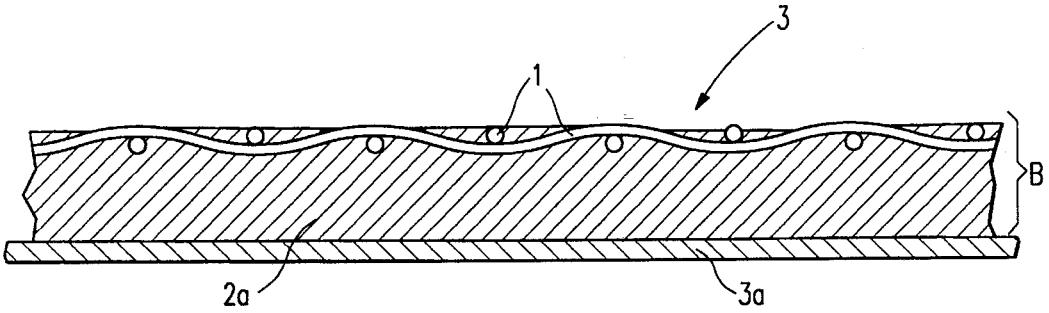
FIG. 2 represents a transverse cross-sectional view of a modified construction of a base of an evaporation chamber.

According to a modified embodiment of the device according to the invention and shown in FIG. 2, layer A is constituted by an additional metal plate B of a material **2*a* intimately bonded to a sole plate 3*a*** of a pressing iron for example, which is thermally conductive.

Plate B, for example made of aluminum, is maintained in thermal and mechanical contact with sole plate **3*a*** by crimping or any other means.

Advantageously, sole plate **3*a*** is a pressing iron sole plate, and plate B is over-molded onto said sole plate.

The anti-calefaction layer thus formed on base 3 at the interior of the evaporation chamber preferably comprises woven hydrophilic and thermally isolating fibers 1.

The fibers 1 utilized to form in part layer A in the evaporation chamber are, according to another form of the device, according to the invention, hydrophilic ceramic fibers, hydrophilic mineral fibers, or hydrophilic synthetic fibers.

By way of non-limiting example, filaments of glass fiber, or composed of a mixture of metal and silica are perfectly suitable, as well as carbon or organic fibers.

According to a supplemental variant of an embodiment of a device according to the invention, the device for generating steam comprises a fabric formed by weaving at least two different types of fibers. In this case, one can envision utilizing in association with hydrophilic and thermally isolating fibers, metallic fibers. It is obvious that the weaving of such fibers is only a preferred variant of an embodiment of a device for generating steam according to the invention.

According to another variant of an embodiment of a device according to the invention, the fibers utilized are non-woven.

The utilization of other materials such as a metal having good thermal conductivity is envisionable for forming base 3, it being a question particularly of alloys comprising aluminum. Obviously, any material intended to form a sole plate of a pressing iron can be suitable for forming an evaporation chamber of a steam generation device according to the present invention.

The present invention also concerns a process for producing a base 3 of an evaporation chamber of a steam generation device. The process consists in utilizing thermally isolating and hydrophilic fibers 1 as well as a thermally conductive material, of the aluminum type, to produce a surface layer A of a base 3.

The process consists in intimately binding the fibers 1 with the base 3 in a layer A of a surface zone of said base 3, in a manner to assure a thermal transfer between said base 3 and the layer A.

According to a preferred embodiment of the process, the fabric of fibers 1 is disposed at the interior of a mold before the injection of a material 2 in a molten state. The intimate mechanical bond between the fabric of fibers 1 and the base 3 is thus realized directly by over-molding. Before the solidification of the molten material 2, this latter at least partially and locally impregnates the fibers 1 in a surface layer A of base 3. The mechanical fixation of the fibers 1 is thus achieved and assured. The material 2 equally presents a surface 4 situated opposite the layer A which performs the functions of a pressing iron sole plate. According to a variant of the process of forming a base 3 of an evaporation chamber, the intimate linking between the fibers 1 and the base 3 is done through the intermediary of a metal plate B utilized as an interface between the fibers 1 and the sole plate 3*a*. One of the process steps consists in intimately linking the fibers 1 with the metallic plate B for example by over-molding.

As a variation, it can be envisioned to fix the fibers 1 with the plate B through the intermediary of a pressing or flattening step.

It is equally envisioned, according to a supplemental variation of the process of forming a base 3 of an evaporation chamber according to the invention, to intimately link the metallic plate B with the sole plate 3*a* by over-molding. Any other means for fixing plate B on sole plate 3*a* permitting a thermal transfer of heat energy toward plate B could equally be suitable.

The step of over-molding the plate B onto the sole plate 3*a* can thus advantageously be replaced by a step of crimping or bonding.

The sole plate 3*a* is preferably utilized directly as a sole plate of a pressing iron.

The advantage of a steam generation device according to the invention and fabricated according to the process of formation of an evaporation chamber of said device, is that it permits an improvement in the evaporation yield, in particular in a steam pressing iron without at the same time increasing the fabrication cost.

Another advantage of a device for generating steam according to the invention is an increased useful life in comparison with existing evaporation devices.

POSSIBILITY OF INDUSTRIAL APPLICATION

The invention finds its industrial application in the field of apparatus intended to produce vapor, and in particular steam pressing irons.

We claim:

1. A steam generating device including an evaporation chamber for evaporating a liquid which is delivered from a reservoir while the chamber is being heated, which chamber includes a base comprising: a body of thermally conductive material having an upper surface against which the liquid to be evaporated is directed, said body having a surface layer extending from the upper surface; and hydrophilic fibers distributed across the upper surface and at least partially and locally embedded in said surface layer.

2. A device according to claim 1 wherein the hydrophilic fibers are molded into said surface layer.

3. A device according to claim 1 further comprising a thermally conductive sole plate, and wherein said surface layer is constituted by an additional metal plate intimately bonded to said sole plate.

4. A device according to claim 3 said metal plate is mechanically connected to said hydrophilic fibers by application of pressure to said fibers.

5. A device according to claim 1 wherein said hydrophilic fibers form a woven fabric and are thermally isolating.

6. A device according to claim 1 wherein said hydrophilic fibers are at least one of ceramic, mineral, or synthetic fibers.

7. A device according to claim 6 wherein said hydrophilic fibers comprise a woven fabric of at least two types of different fibers.

8. A pressing iron containing a steam generating device as defined in claim 1.

9. A device according to claim 1 wherein said hydrophilic fibers are of thermally isolating material.

10. A process for producing a base of an evaporation chamber, the base being composed of a body of thermally conductive material having an upper surface, said process comprising intimately binding fibers of thermally insulating, hydrophilic material with the body of thermally conductive material at the upper surface, and at least partially impregnating said fibers with the thermally conductive material in order to promote heat transfer from the base to liquid which is present on the upper surface in order to evaporate the liquid.

11. Process according to claim 10 wherein the body is composed of a metal plate extending from the upper surface and a sole plate connected to a surface of the metal plate which is remote from the upper surface, and said step of intimately binding the fibers is carried out by intimately binding the fibers into the metal plate.

12. Process according to claim 11 wherein said step of intimately binding the fibers into the metal plate is carried out by intimately linking the fibers with the metal plate by application of pressure to said fibers.

13. Process according to claim 11 wherein said step of intimately binding the fibers into the metal plate is carried out by intimately linking the fibers with the metal plate by molding.

14. Process according to claim 11 further comprising intimately linking the metal plate with the sole plate by molding.

15. Process according to claim 11 further comprising intimately linking the metal plate with the sole plate by crimping.

16. Process according to claim 10 wherein said step of intimately binding is carried out by intimately linking the fibers with the body directly by molding in a manner such that the material constituting the body at least partially and locally impregnates the fibers in a layer adjacent said upper surface of said body.

* * * * *